US006324716B1

(12) United States Patent
Holmes et al.

(10) Patent No.: US 6,324,716 B1
(45) Date of Patent: Dec. 4, 2001

(54) BRUSH

(75) Inventors: Richard A. Holmes; William H. Houghton, both of Akron; Paul G. Ouillette, Stow; John P. Cichello, II, Wooster, all of OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 09/487,464

(22) Filed: Jan. 19, 2000

(51) Int. Cl.[7] ..... A46B 3/00
(52) U.S. Cl. ..... 15/113; 15/167.3; 15/187
(58) Field of Search ..... 15/111, 113, 160, 15/161, 112, 167.3, 187; D4/118, 199

(56) References Cited

U.S. PATENT DOCUMENTS

| | | | | |
|---|---|---|---|---|
| D. 338,297 | | 8/1993 | Singarella . | |
| D. 346,332 | | 4/1994 | Kanfer et al. . | |
| D. 383,001 | | 9/1997 | Bell et al. . | |
| 716,740 | | 12/1902 | Muller et al. . | |
| 864,676 | | 8/1907 | Nagely . | |
| 2,859,463 | | 11/1958 | Hirsch . | |
| 3,354,492 | | 11/1967 | Baumgartner . | |
| 3,387,313 | * | 6/1968 | Smith et al. | 15/111 |
| 3,467,978 | * | 9/1969 | Golden | 15/111 |
| 3,754,831 | | 8/1973 | Hutter . | |
| 3,843,991 | | 10/1974 | Vallis . | |
| 3,966,335 | * | 6/1976 | Abramson | 15/167.3 |
| 4,420,853 | | 12/1983 | Gilman . | |
| 4,480,351 | * | 11/1984 | Koffler | 15/167.3 |
| 4,618,443 | | 10/1986 | Jude . | |
| 4,757,571 | | 7/1988 | Young . | |
| 5,077,858 | * | 1/1992 | Lewis | 15/161 |
| 5,299,876 | | 4/1994 | Singaarella . | |
| 5,312,197 | | 5/1994 | Abramson . | |
| 5,355,545 | | 10/1994 | Hoagland . | |
| 5,442,829 | | 8/1995 | Summers . | |
| 5,558,453 | | 9/1996 | Bell et al. . | |
| 5,729,858 | * | 3/1998 | Riffel | 15/111 |
| 6,036,389 | | 3/2000 | Zima . | |

* cited by examiner

*Primary Examiner*—Terrence R. Till
(74) *Attorney, Agent, or Firm*—Reese Taylor

(57) ABSTRACT

A multi-purpose brush incorporating structure which permits the selective performance of a plurality of cleaning operations with a single brush is disclosed. The brush includes a body which has a first series of relatively soft flexible bristles thereon and a second series of bristles thereon which are shorter and stiffer. The body also has a roughened area comprising a plurality of short, stubby projections. The body also has opposed depending legs, at least one of which terminates in a tapered or sharpened point.

5 Claims, 2 Drawing Sheets

BRUSH

FIELD OF THE INVENTION

This invention relates in general to brushes for use on the hands and skin of human beings and relates in particular to a brush incorporating features which enable a multiplicity of cleaning operations to be achieved with one brush.

BACKGROUND OF THE INVENTION

It has long been known that brushes can be used to assist in cleaning the human body and particularly for cleaning the hands. These brushes come in many sizes and shapes and configurations, but primarily include a body and/or some means for gripping the brush, usually incorporated into the body, and a plurality of bristles projecting from the brush and enabling the user to achieve a greater cleaning efficiency than would otherwise be possible with a conventional washcloth, sponge, etc. Some brushes are provided with relatively stiff bristles to assist in removing difficult to remove dirt while others have relatively flexible or "soft" bristles for use on tender skin or where vigorous dirt removal is not required. Such brushes have particular utility in cleaning the hands, fingers and fingernails of the user and are particularly adapted to situations in which significant grime or dirt is present and is difficult to remove.

It has also been known in the prior art to provide sharpened means, usually incorporated in fingernail files or fingernail clippers, to enable dirt to be removed from beneath the fingernails.

Heretofore, however, it has been necessary in the past to provide a number of utensils of this general nature in order to enable the user to perform a complete cleaning operation on his or her hands.

Accordingly, it is believed desirable to provide a combination brush which, in one implement, contains all of the features necessary to accomplish what heretofore has been accomplished with a plurality of implements.

SUMMARY OF THE INVENTION

It accordingly becomes the principal object of this invention to provide a brush wherein the brush is provided with a plurality of features which enable a plurality of cleaning operations to be performed with the same basic implement.

To that end, it has been discovered that this object can be achieved by providing a brush having a main body portion and opposed side legs depending therefrom and opposed end legs depending from the opposed ends thereof. It has been found that a plurality of bristles can be provided on the upper surface of the main body portion to effectuate the cleaning operation.

It has also been discovered that the cleaning ability of the brush can be enhanced by providing a first series of bristles projecting from the surface of the main body portion which are relatively long and flexible. It has been found that these bristles can accomplish the cleaning operation to remove dirt or grime which is not seriously embedded into the skin or cuticles of the user.

It has also been found that a second shorter, stiffer series of bristles can be provided adjacent the first series to assist the user in removing more difficult to dislodge dirt or grime.

It has also been found that a plurality of roughened areas can be provided outboard of the bristles on the main body portion for removing particularly hard to remove dirt or grime.

Additionally, it has been found that an improved brush can be provided in which the depending end legs terminate in sharpened points. This enables the fingernail cleaning function to be performed with the same implement used to clean the skin.

It has further been found that the objects of the invention can be further realized by providing, on at least one of the depending side legs, an apertured connecting lug integral with the side legs which enables the brush to be hung on a projecting member such as a nail or attached to a lanyard which enables the brush to be hung when not in use.

These and other objects of the invention will become more apparent upon a reading of the following brief specification considered and interpreted in view of the accompanying drawings.

BRIEF DESCRIPTION OF THE PREFERRED EMBODIMENTS

Figure 1:
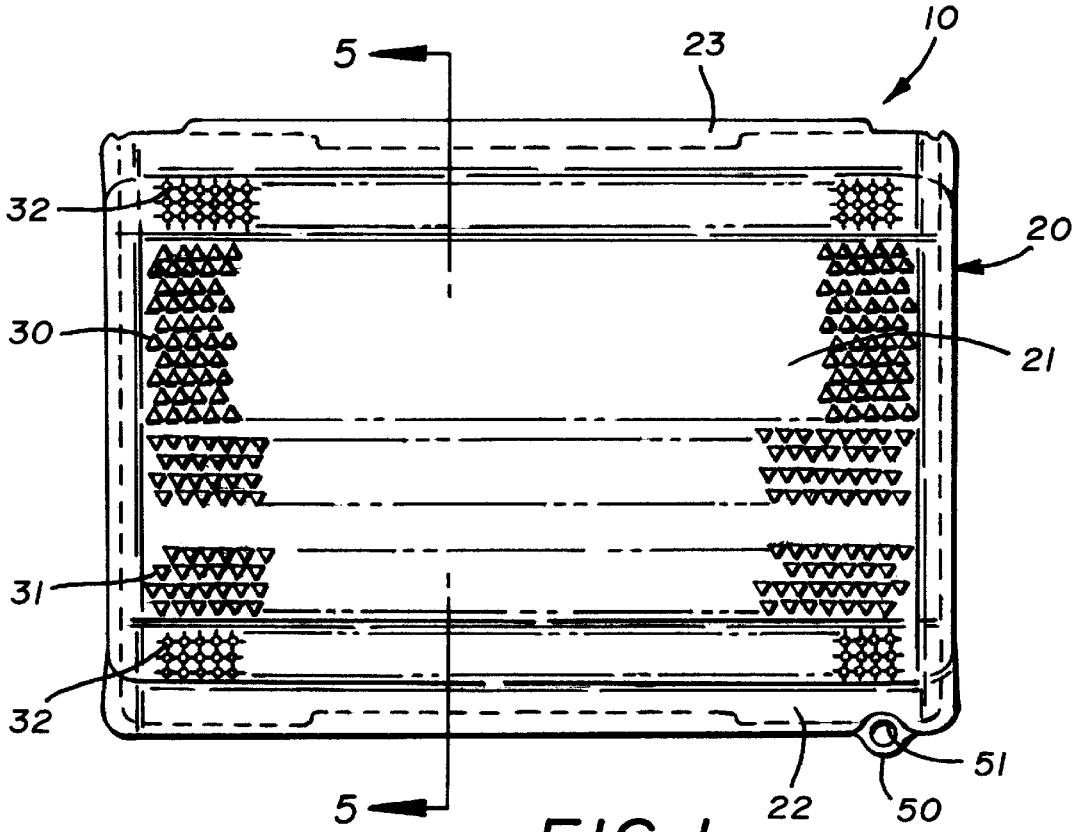
FIG. 1 is a top plan view of the improved brush.

Referring first to FIG. 1 of the drawings, the improved brush, generally indicated by the numeral 10, is illustrated as including a main body portion 20 which has upper and lower surfaces 21 and 21*a*.

Disposed on the upper surface 21 are two series of bristles.

The first series of bristles 30 are relatively long and flexible and are intended to be used in cleaning the skin of the user and particularly in cleaning areas in which the dirt or grime is not deeply embedded.

A second series of bristles 31 is also provided on the top surface adjacent the first series of bristles 30. These bristles, as illustrated, are relatively short and much stiffer than the first series and are intended to be used to remove more deeply embedded grime or dirt.

It will be noted that the main body portion 20 also has depending side legs 22 and 23 and depending end walls 40 and 41.

It will be seen from FIGS. 1 through 5 of the drawings that roughened areas 32 are provided adjacent the juncture of the top wall 21 and the side walls 22 and 23. These roughened areas take the form of projections which are triangular in cross-section and which are intended to be used for removing exceptionally difficult to remove or deeply embedded dirt and grime, particularly in the fingernail area, but also could be used in other areas. Inasmuch as they are provided on the line of juncture between the top wall 21 and the side walls 22 and 23, it is believed apparent that they would be accessible without interference from the bristles 30 or 31.

Figure 3:
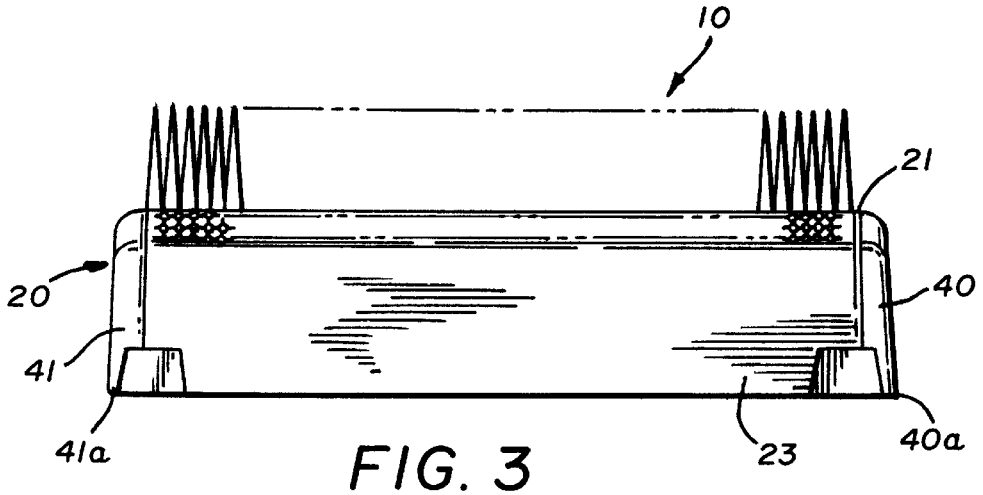
FIG. 3 is a side elevational view taken from the top of FIG. 1.
Figure 4:
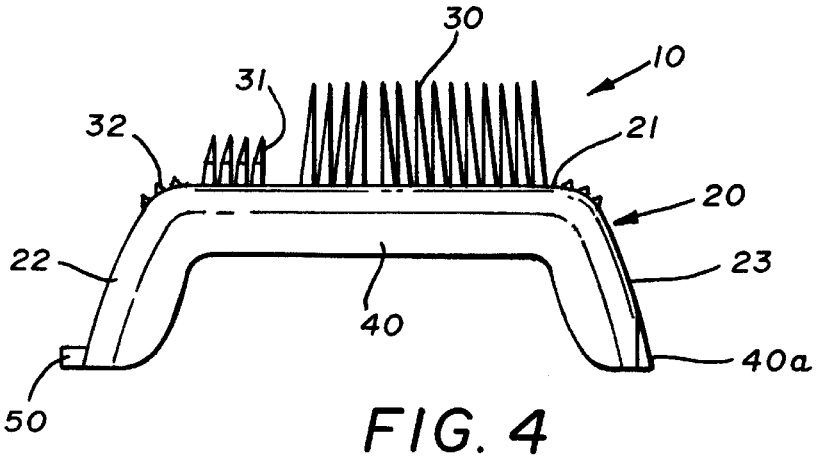
FIG. 4 is an end elevational view taken from the right of FIG. 1.
Figure 5:
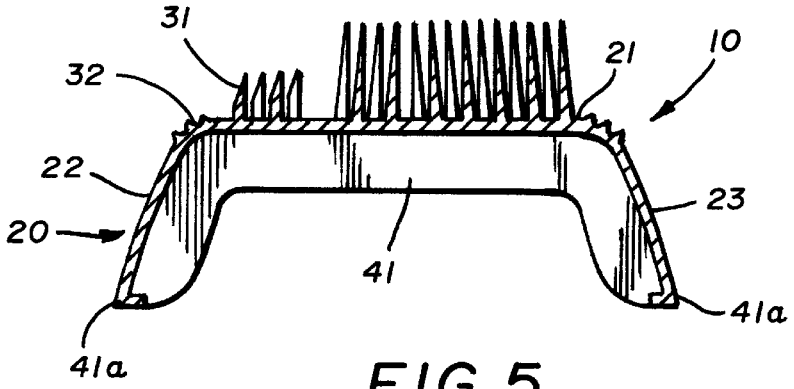
FIG. 5 is a sectional view taken along the line 5—5 of FIG. 1.

It will be noted from FIGS. 3, 4 and 5 of the drawings that the end walls 40 and 41 terminate in sharpened or pointed edges 40*a* and 41*a*. These edges are utilizable for cleaning beneath the fingernails similar to a conventional fingernail file or fingernail clipper attachment. This enables a complete cleaning operation to be performed, particularly on the hands of the user, utilizing the bristles 30,31 and the roughened areas 32 and pointed distal ends of the end walls 40*a* and 41*a*. Alternatively, only selected cleaning features may be employed as required.

Figure 2:
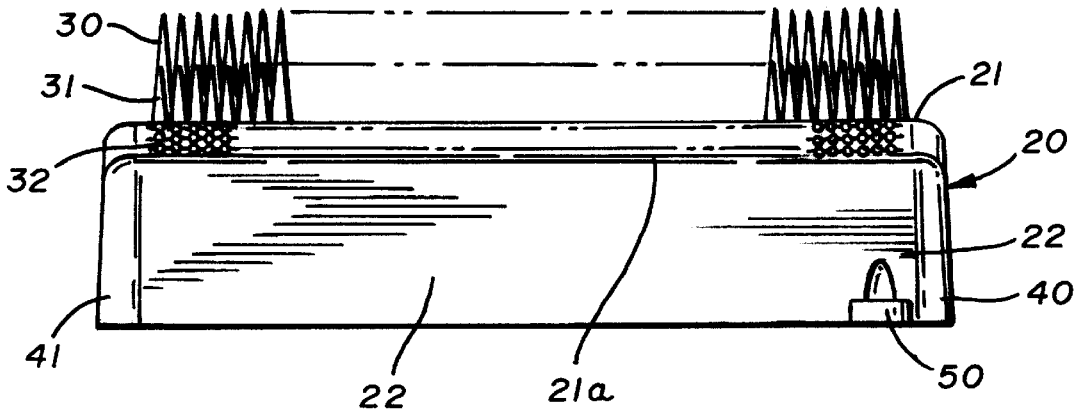
FIG. 2 is a side elevational view of the improved brush taken from the bottom of FIG. 1.

With reference to FIGS. 2 and 4 of the drawings, it will be noted that an attachment lug 50 also projects from side wall 22. This attachment means has a through aperture 51 (see FIG. 1) which enables the brush 10 to be hung on a wall-mounted projection, such as a nail or hook, and also enables, if desired, a lanyard to be attached to the brush 10.

It is, therefore, believed that an improved brush capable of providing the user with access to a plurality of cleaning implements in a single brush has been disclosed herein. It is contemplated that the bristles and roughened areas will be molded into the brush and it will be one integral piece, although other means of fabrication could be employed if desired.

While a full and complete description of the invention has been set forth in accordance with the dictates of the patent statutes, it should be understood that modifications can be resorted to without departing from the spirit hereof or the scope of the appended claims.

What is claimed is:

1. A brush for use on the skin of a person, comprising:

a) a brush body having
   1) a main body portion with top and bottom surfaces and opposed side and end edges, and
   2) opposed side legs integral with and depending from opposed side edges of said main body portion;

b) a first series of bristles projecting from said top surface of said main body portion;

c) a second, shorter series of bristles projecting from said top surface of said main body portion and disposed between said first series of bristles and said side edges; and d) a roughened area disposed between said second, shorter series of bristles and said opposed side edges of said main body portion.

2. The brush of claim 1 wherein said main body portion includes opposed end walls depending from said opposed end edges; and at least one of said end walls terminate in pointed distal ends.

3. The brush of claim 1 wherein an apertured connecting lug projects from at least one of said side legs.

4. A brush for use on the skin of a person, comprising:

a) a brush body having
   1) a main body portion with top and bottom surfaces and opposed side and end edges, and
   2) opposed side legs integral with and depending from opposed side edges of said main body portion;

b) a first series of bristles projecting from said top surface of said main body portion;

c) a second, shorter series of bristles projecting from said top surface of said main body portion and disposed adjacent said first series of bristles;

d) a roughened area disposed adjacent said opposed side edges of said main body portion;

e) said main body portion includes opposed end walls depending from said opposed end edges; and f) at least one of said end walls terminate in pointed distal ends.

5. A brush for use on the skin of a person, comprising:

a) a brush body having
   1) a main body portion with top and bottom surfaces and opposed side and end edges, and
   2) opposed side legs integral with and depending from opposed side edges of said main body portion;

b) a first series of bristles projecting from said top surface of said main body portion;

c) a second, shorter series of bristles projecting from said top surface of said main body portion and disposed adjacent said first series of bristles; and d) a roughened area disposed adjacent said opposed side edges of said main body portion and;

e) an apertured connecting lug projects from at least one of said side legs.

* * * * *